US006160483A

United States Patent [19]

Radwan

[11] Patent Number: 6,160,483

[45] **Date of Patent: *Dec. 12, 2000**

[54] COMPOSITE BATTERY-TRANSMITTER

[76] Inventor: Abdel-Aziz Radwan, 18 Alex Avenue, Moorabbin, Victoria 3189, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/159,295

[22] Filed: Sep. 23, 1998

[30] Foreign Application Priority Data

Sep. 25, 1997 [AU] Australia ..... PO9456

[51] Int. Cl.[7] ..... G08B 17/10

[52] U.S. Cl. ..... 340/628; 340/636; 340/693.1; 340/693.5

[58] Field of Search ..... 340/628, 636, 340/539, 693.1, 693.2, 693.3, 693.4, 693.5, 693.6, 693.7

[56] References Cited

U.S. PATENT DOCUMENTS

| | | | |
|---|---|---|---|
| 4,335,375 | 6/1982 | Schaeffer | 340/539 |
| 4,581,606 | 4/1986 | Mallory | 340/539 |
| 5,235,320 | 8/1993 | Romano | 340/539 |
| 5,455,566 | 10/1995 | Conway | 340/693 |
| 5,654,692 | 8/1997 | Baxter, Jr. et al. | 340/539 |

*Primary Examiner*—Daniel J. Wu
*Assistant Examiner*—Toan Pham
*Attorney, Agent, or Firm*—Chupa and Alberti, PC

[57] ABSTRACT

A composite battery-transmitter for use in powering an electronic device has a set of terminals, a battery, a radio transmitter, and current sensing circuitry housed within a casing which is in the shape of a conventional battery. The electronic device can be attached to the terminals. When the electronic device draws a load current, that current is sensed and the radio transmitter transmits a signal.

16 Claims, 3 Drawing Sheets

COMPOSITE BATTERY-TRANSMITTER

FIELD OF INVENTION

This invention relates to a composite battery-transmitter and relates particularly but not exclusively to a composite battery-transmitter for use in smoke detectors and other electronic devices.

BACKGROUND OF THE INVENTION

Conventionally smoke detectors have been known in which a battery, most usually a rectangular 9V battery (such as Eveready 216, 522 or 1222 or Duracell MN1604) is used to supply current to sound an alarm when activated by an ionisation chamber. Batteries are typically used for convenience of installation and relative economy. Using batteries obviates the need to connect to an external power supply, and batteries may be readily replaced when flat.

However, an improved smoke detector is envisaged wherein the smoke detector includes a transmitter. This is a highly desirable feature as the transmitted signal may be received by a nearby security system which can raise an alarm (e.g. through the conventional pubic switched telephone network). This is particularly useful in situations in which the premises are unattended, or if the audio alarm is otherwise unlikely to be heard, such as during the night, or at a retirement home.

At present it is only known to achieve this functionality by replacing the conventional smoke detector with a purpose-built smoke detector which specifically incorporates these features. However, the applicant has conceived that it is possible to retrofit existing conventional smoke detectors with a composite battery-transmitter according to an embodiment of the present invention. This modification is particularly elegant as it does not change the internal space of the smoke detector which might otherwise interfere with the smoke-detecting ability of the ionisation chamber. For this reason it substantially conforms in this respect with the anticipated Australian Standard for wireless smoke detectors. It is particularly desirable to recycle existing conventional smoke detectors rather than merely replacing them. This is because conventional smoke detectors contain radioactive materials in the ionisation chamber. Accordingly they should not be dismantled, destroyed or disposed of by untrained people. Thus recycling of smoke detectors obviates disposal problems while being particularly convenient.

SUMMARY OF THE INVENTION

According to an aspect of the present invention there is provided a composite battery-transmitter for use in an electronic device having:

terminal means;

battery means capable of supplying energy to the electronic device through the terminal means; and transmitter means capable of transmitting a signal, wherein the composite battery-transmitter has an external casing consistent with the shape of a conventional battery.

It is preferred that the terminal means are adapted to receive connection terminals designed for a conventional 9V battery.

It is preferred that the composite battery-transmitter is adapted so that the transmitter means transmits a signal when the electronic device draws a substantial electrical current from the battery means.

It is preferred that the battery means includes one or more lithium-based batteries.

It is preferred that the conventional battery is a 9V battery.

According to another aspect of the present invention there is provided a composite battery-transmitter for use in an electronic smoke detector having:

terminal means;

battery means capable of supplying energy to the smoke detector through the terminal means; and transmitter means capable of transmitting a signal, wherein the composite battery-transmitter has an external casing consistent with the shape of a conventional battery.

According to a further aspect of the present invention there is provided a composite battery-transmitter for use in a conventional smoke detector as part of an integrated security system.

BRIEF DESCRIPTION OF THE VIEWS OF THE DRAWINGS

In order that the nature and scope of the present invention may be better understood, an embodiment of the present invention will now be described specifically in particular relation to smoke detectors in relation to the accompanying drawings, in which.

In the above listed diagrams, the following features are labeled as set out below:

10-terminals
20-battery stack
30-current sensor
40-encoder
50-supervision timer
60-radio transmitter
70-antenna
80-digital board
90-analog board
100-external casing.

DETAILED DESCRIPTION WITH RESPECT TO THE DRAWINGS

The embodiment of the present invention described herein is in relation to 9V batteries, such as Eveready 216, 522 or 1222, or Duracell MN1604. Batteries of this type have substantially the following average dimensions:

breadth: 25.5 mm height: 44.5 mm width: 16.5 mm.

The external casing 100 of the composite battery-transmitter is approximately of these dimensions.

The composite battery-transmitter also has terminals 10 which are interchangeable with those of a 9V battery. These terminals on the electronic device and the composite battery-transmitter are the known miniature snap fastener arrangement as used on 9V batteries and devices designed to use them. This is clearly shown in the accompanying figures.

Figure 1:
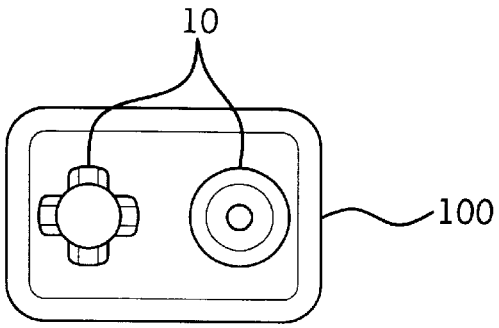
FIG. 1 is a top view of the external casing of the composite battery-transmitter according to an embodiment of the present invention.
Figure 2:
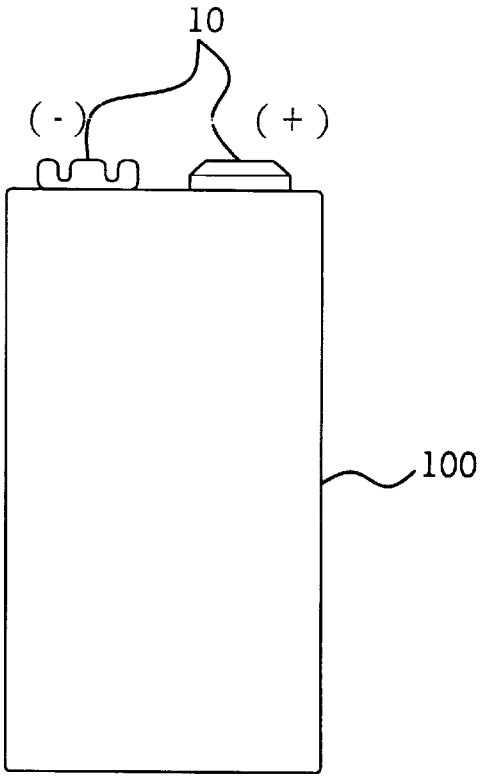
FIG. 2 is a side view of the external casing of the composite battery-transmitter according to an embodiment of the present invention.
Figure 3:
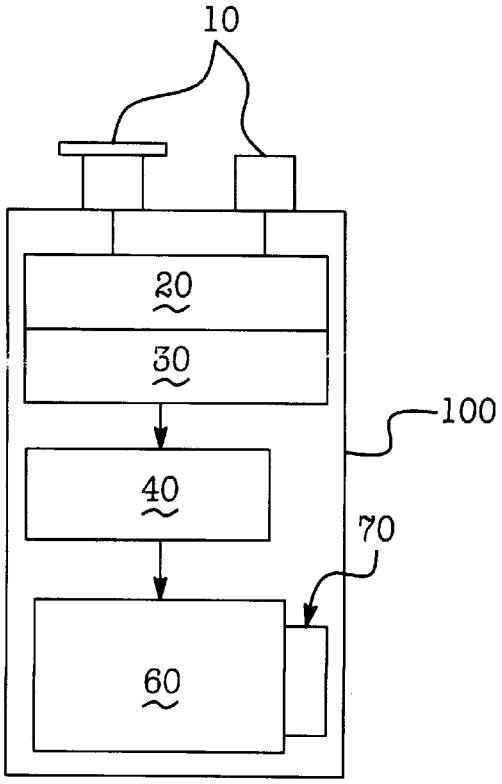
FIG. 3 is a schematic diagram of the composite battery-transmitter according to an embodiment of the present invention.

In FIG. 3 there is illustrated a schematic diagram showing the main functional features of the composite battery-transmitter.

The composite battery-transmitter includes a battery stack 20 to provide a 9V (nominal) battery supply to power the smoke detector. The battery stack 20 uses lithium batteries to achieve the necessary economy of space which is required to fit the circuitry within the required volume. Lithium batteries are also long-lived, requiring less frequent replacement than some other batteries.

The current sensor 30 monitors the load current drawn from the battery stack 20. If the load current is above a predetermined threshold, the encoder 40 is activated. The encoder 40 determines whether the load current is a pilot LED load current for indicating the operation of the smoke detector, or a smoke detector load current for sounding an alarm that the smoke detector has detected smoke. If the load current is a smoke detector load current, the encoder 40 generates a modulation code for the radio transmitter 60. This may be generally received by an appropriate corresponding receiver/decoder. The signal actually is transmitted by way of the antenna 70 connected to the radio transmitter 60.

Figure 4:
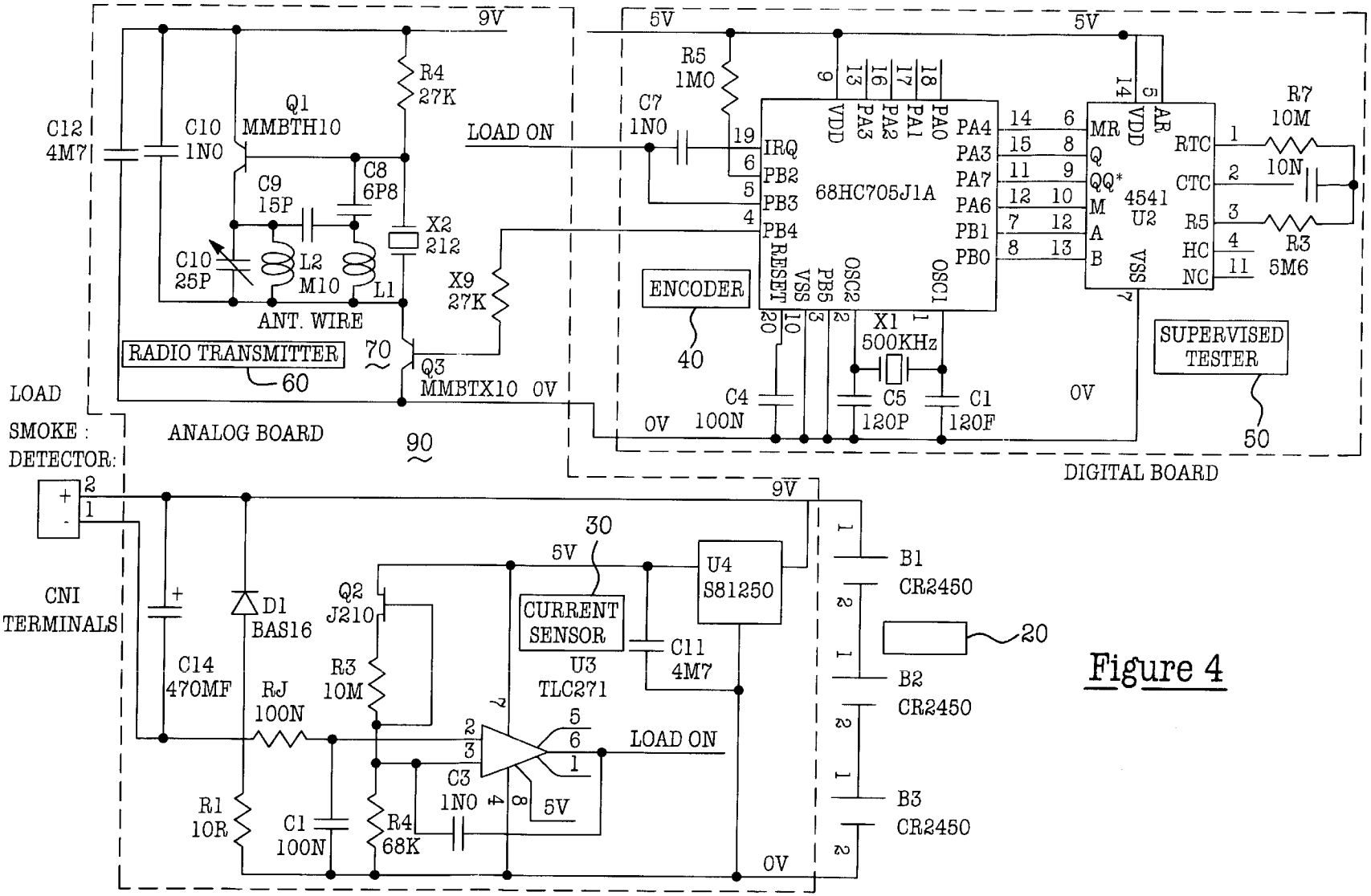
FIG. 4 is a schematic diagram of the circuit of the composite battery-transmitter according to an embodiment of the present invention.
Figure 5:
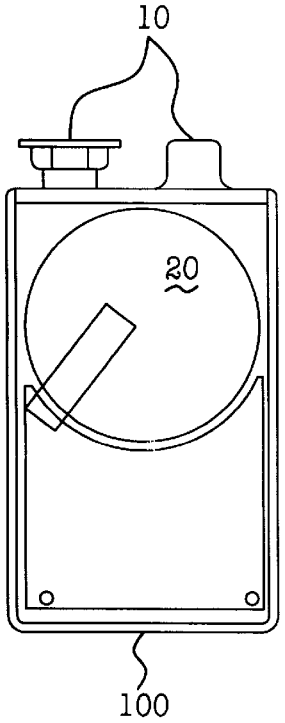
FIG. 5 is a cutaway front view of the structure of the composite battery-transmitter according to an embodiment of the present invention.
Figure 6:
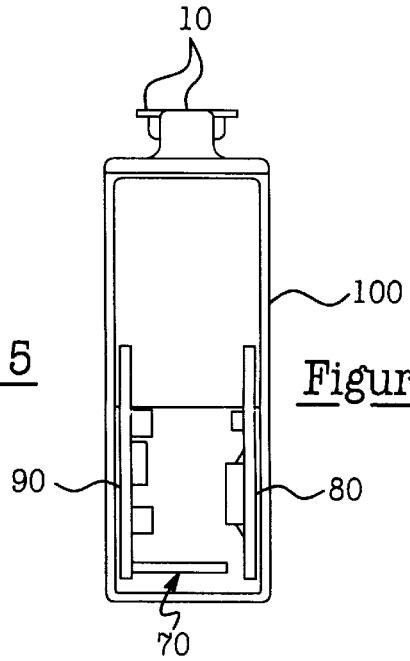
FIG. 6 is a cutaway side view of the composite battery-transmitter according to an embodiment of the present invention.
Figure 7:
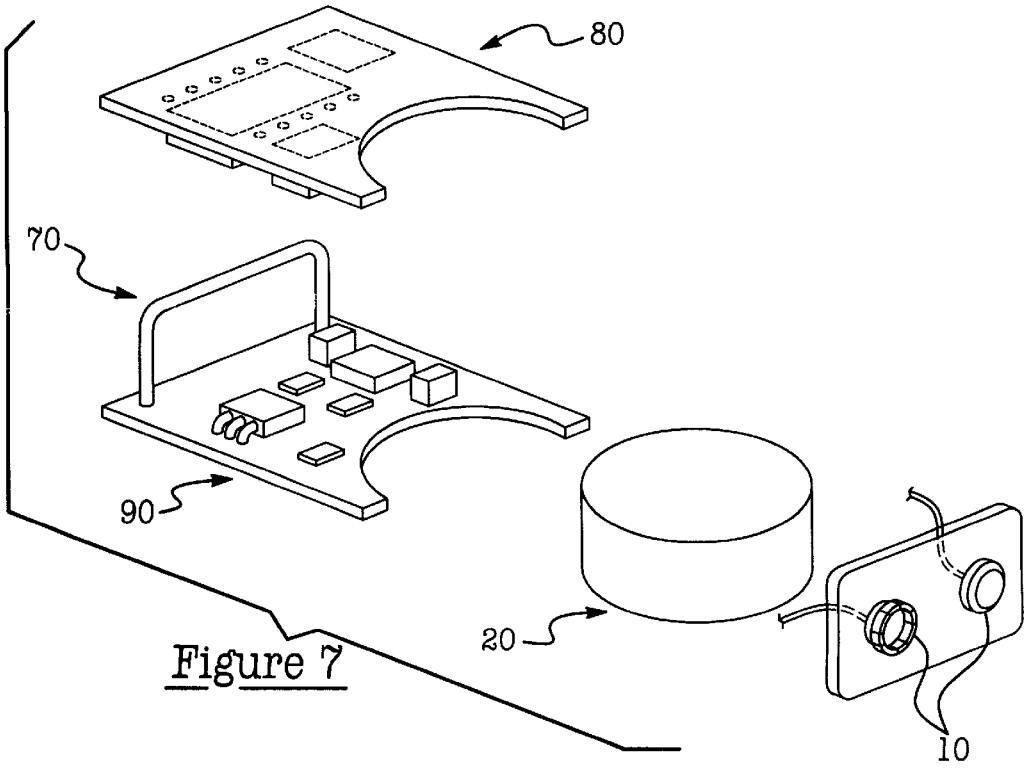
FIG. 7 is a schematic diagram of the construction of the composite battery-transmitter according to an embodiment of the present invention.

The composite battery-transmitter is designed so that the load current at quiescent conditions is relatively low (in the order of a few microamps). This is designed to maximise the operational life of the lithium batteries in the battery stack 20. The load current at quiescent conditions (which may be typically 5 $\mu$A) will be below the predetermined threshold and accordingly does not activate the encoder 40. When the load current exceeds the predetermined threshold, the encoder 40 is activated and responds accordingly. Filters are used so that the encoder 40 is not unnecessarily activated by load spikes. In FIG. 4, this functionality is provided by C14, R2 and C1. J-FET Q2, along with R3 form a constant current source, which in conjunction with R4, forms a voltage reference which is used to sense the predetermined threshold of the load current.

The radio transmitter 60 uses a surface acoustic wave (SAW) resonator to provide a stable radio frequency source for communication of signals (alarm or otherwise). The range of the radio transmitter 60 should be sufficient to reach a corresponding receiver/decoder. In preferred embodiments the range of the radio transmitter 60 is usually between 30 m and 50 m.

The circuitry of the current sensor 30 is designed so that a minimal voltage drop is placed in series with the lithium batteries in the battery stack 20. This is in order to maximise the battery voltage which is actually supplied to the load through the terminals 10 while allowing for reliable detection of the smoke detector load current.

The circuitry of the composite battery-transmitter is constructed in accordance with the circuit illustrated in FIG. 4. The circuitry shown in FIG. 4 includes a transmitter means and a battery means as is known to the person skilled in the art.

The transmitter means includes a radio transmitter 60 and an antenna 70.

The composite battery-transmitter also includes a supervision timer 50. This is shown in FIG. 4. The supervision timer 50 draws a very low current (less than 2 $\mu$A). The function of the supervision timer 50 is to provide the encoder 40 with the periodic 'wake-up' signals to allow regular checking of the status of the composite battery-transmitter and the smoke detector.

The voltage regulator (also shown in FIG. 4) provides a stable supply voltage to the current sensor 30, encoder 40, and supervision timer 50 circuits. Diode Dl provides protection to the circuitry of the composite battery-transmitter should a reverse voltage be applied to the load terminals 10. The terminals 10 are also shown in FIG. 4 as CN1.

In FIG. 4, the filtering circuitry, battery stack 20 and current sensor 30 are shown schematically in the lower portion of FIG. 4. Above this the circuitry is broken down into circuitry which appears on an analog board 80 and on a digital board 90. The analog board 80 contains circuitry for the radio transmitter 60 and antenna 70. The digital board contains circuitry for the encoder 40, and the supervision timer 50. The current sensor 30 and the encoder 40 are able, in combination, to detect the switching of load current. By externally modulating a load onto the composite battery-transmitter terminals 10, it is possible that coded information can be 'sent' to the composite battery-transmitter. This may be used to program information such as a unique identification code (ID) for each composite battery-transmitter, the type of radio coding to be used during transmission, or any other relevant information.

The composite battery-transmitter may also be programmed into a 'shipping mode' where circuit activity is minimised and radio transmission is halted. This is appropriate and desirable during periods where the composite battery-transmitter is to be inactive, such as during delivery to retail outlets, or while being held in storage.

While the circuitry of the composite battery-transmitter is disclosed herein in relation to a particular preferred embodiment, any appropriate arrangement which is sufficiently compact to fit within the external casing of the composite battery-transmitter may fall within the scope of the present invention. Thus it is to be understood that the battery means and transmitter means of the present invention are not limited to those described herein and illustrated in the accompanying drawings. Many other embodiments are possible.

Furthermore, additional functionality may be provided which is within the scope of the present invention. For example, a transmission protocol may be established to enable communication of various information to a receiver.

Also, there may be additional terminal means to receive other inputs/outputs. Integrated semiconductor circuits may be incorporated to provide relatively sophisticated functionality, as could be provided by a person skilled in the art.

The present invention is of course not limited to 9V batteries and may applied with success to other battery size/shape/voltages.

While a preferred embodiment of the present invention has been described in relation to smoke detectors, it is to be understood that the present invention has far broader application to many other electronic devices and electronic systems.

Embodiments of the present invention may be adapted for use in devices/systems such as residential and automotive security alarm systems, surveillance devices, children's toys, remote control devices and the like.

The claims defining the invention are as follows:

1. A composite battery and transmitter combination which are operatively disposed within a single housing for use in an electronic device having:

terminal means;

battery means capable of supplying energy to the electronic device through the terminal means; and transmitter means capable of transmitting a signal, wherein the combined battery and transmitter has an external casing of the exact physical dimensions of a typical 9-volt cell battery.

2. A composite battery-transmitter as claimed in claim 1 wherein the terminal means are adapted to receive connection terminals designed for a conventional 9V battery.

3. A composite battery-transmitter as claimed in claim 1 or claim 2 wherein the transmitter means transmits a signal when the electronic device draws a substantial electrical current from the battery means.

4. A composite battery-transmitter as claimed in claim 3 wherein the battery means includes one or more lithium-based batteries.

5. A composite battery-transmitter as claimed in claim 1 wherein the battery means is a 9V battery.

6. A composite battery-transmitter for use in an electronic smoke detector having:

terminal means;

battery means capable of supplying energy to the smoke detector through the terminal means; and transmitter means capable of transmitting a signal, wherein the composite battery-transmitter has an external casing of the exact physical dimensions of a typical 9-volt dry cell battery.

7. A composite battery-transmitter as claimed in claim 6 wherein the terminal means are adapted to receive connection terminals designed for a conventional 9V battery.

8. A composite battery-transmitter as claimed in claim 6 or claim 7 wherein the transmitter means transmits a signal when the electronic device draws a substantial electrical current from the battery means.

9. A composite battery-transmitter as claimed in claim 8 wherein the battery means includes one or more lithium-based batteries.

10. A composite battery-transmitter as claimed in claim 6 wherein the battery means is a 9V battery.

11. A composite battery-transmitter for use in a conventional smoke detector as part of an integrated security system, wherein the composite battery-transmitter has an external casing of the exact physical dimensions of a typical 9-volt dry cell battery.

12. A composite battery transmitter as in claim 11 further comprising an integrated internal battery power source; a transmitter that emits a signal; an antenna that broadcasts said transmitter signal; a monitoring circuit; an analog circuit board; a digital circuit board; and a casing.

13. A casing as in claim 12 further comprising conventional 9-volt dry cell battery negative and positive connection terminals allowing the installation of said composite battery transmitter completely within the confines of a conventional battery housing made for a said conventional 9-volt dry cell battery.

14. A composite battery transmitter as in claim 12 further comprising said integrated internal power source that is selectively and electrically disengagable from the remainder of the said composite battery transmitter circuitry providing a "shipping mode" in which no power is consumed.

15. A monitoring circuit as in claim 12 further comprising a portion of the said analog board and portion of said digital board which is selectively programmable to trigger said transmitter upon detecting desired signal inputs.

16. A monitoring circuit as in claim 15 further comprising a capability to selectively program "coded information" into said triggering of said transmitter to provide unique identification code for the specific recognition of said composite battery transmitter by devices or apparatus receiving said composite battery transmitter's output signal.

* * * * *